US010036554B2

(12) United States Patent
Mackle et al.

(10) Patent No.: US 10,036,554 B2
(45) Date of Patent: Jul. 31, 2018

(54) WOOD PELLET BOILER

(71) Applicant: Warmflow Engineering Company Limited, Lisburn (GB)

(72) Inventors: Gerard Mackle, Lisburn (GB); Jason Cassells, Lurgan (GB)

(73) Assignee: Warmflow Engineering Company Limited, Lisburn (GB)

( * ) Notice: Subject to any disclaimer, the term of this patent is extended or adjusted under 35 U.S.C. 154(b) by 367 days.

(21) Appl. No.: 14/699,252

(22) Filed: Apr. 29, 2015

(65) Prior Publication Data

US 2015/0316268 A1 Nov. 5, 2015

(30) Foreign Application Priority Data

Apr. 30, 2014 (GB) ..... 1407569.1

(51) Int. Cl.

| | |
|---|---|
| ***F24B 13/00*** | (2006.01) |
| ***F23H 15/00*** | (2006.01) |
| ***F24B 13/02*** | (2006.01) |
| ***F24B 1/02*** | (2006.01) |
| ***F23B 30/00*** | (2006.01) |
| ***F24B 13/04*** | (2006.01) |

(52) U.S. Cl.

CPC ..... *F24B 13/008* (2013.01); *F23B 1/38* (2013.01); *F23H 15/00* (2013.01); *F24B 1/02* (2013.01); *F24B 1/024* (2013.01); *F24B 13/004* (2013.01); *F24B 13/006* (2013.01); *F24B 13/02* (2013.01); *F24B 13/04* (2013.01)

(58) Field of Classification Search

CPC ..... F23J 1/00; F23J 1/04; F23J 1/06; F23J 2900/01021; F24B 1/02; F24B 1/024; F24B 13/004; F24B 13/006; F24B 13/02

USPC ..... 126/173, 152 B, 165 R

See application file for complete search history.

(56) References Cited

U.S. PATENT DOCUMENTS

| | | | | |
|---|---|---|---|---|
| 719,358 | A | 1/1903 | McDonald | |
| 1,421,989 | A * | 7/1922 | Gilbert | F27B 21/06 126/173 |
| 5,873,356 | A | 2/1999 | Vossler et al. | |

(Continued)

FOREIGN PATENT DOCUMENTS

| | | | |
|---|---|---|---|
| CN | 202403282 | U | 8/2012 |
| DE | 20312259 | U1 | 10/2003 |

(Continued)

OTHER PUBLICATIONS

Translation of CN202403282; retrieved electronically on May 24, 2017.*

(Continued)

*Primary Examiner* — David J Laux

(74) *Attorney, Agent, or Firm* — Pepper Hamilton LLP

(57) ABSTRACT

The present application relates to improvements to granular fuel burning boilers such as wood pellet boilers and burners therefor. In particular, there is disclosed a wood pellet boiler having a combustion chamber, wherein an access door for said combustion chamber comprises a wood pellet burner assembly mounted on the interior side thereof. In this way, the wood pellet burner assembly is movable from and into the combustion chamber of the wood pellet boiler when the access door is opened and closed, respectively.

10 Claims, 6 Drawing Sheets

(56) References Cited

U.S. PATENT DOCUMENTS

| | | | | |
|---|---|---|---|---|
| 5,893,358 | A * | 4/1999 | Whitfield | F23B 1/38 110/110 |
| 2011/0048398 | A1 | 3/2011 | Christensen et al. | |
| 2014/0116411 | A1* | 5/2014 | Jewett | F24B 1/195 126/19 R |

FOREIGN PATENT DOCUMENTS

| | | | |
|---|---|---|---|
| DE | 202008016293 | U1 | 4/2009 |
| EP | 2098780 | A1 | 9/2009 |
| FR | 2541430 | A1 | 8/1984 |
| KR | 20100113927 | A | 10/2010 |
| KR | 20110039805 | A | 4/2011 |
| KR | 20110052985 | A | 5/2011 |
| KR | 20110099070 | A | 9/2011 |
| KR | 20110116931 | A | 10/2011 |
| KR | 20120019284 | A | 3/2012 |
| KR | 20130011535 | A | 1/2013 |

OTHER PUBLICATIONS

Translation of DE20312259; retrieved electronically on May 24, 2017.*

Tranlsation of KR20120082611 (Labeled as App. No. KR101238954 in the translation); retrieved electronically on May 24, 2017.*

United Kingdom Search Report for GB1407569.1 dated Nov. 4, 2014.

European Search Report for EP 15165265 dated Aug. 25, 2015.

* cited by examiner

WOOD PELLET BOILER

The present application relates to improvements to granular fuel burning boilers, such was wood pellet boilers, and burners therefor. In particular, the present application relates to an improved access door for the combustion chamber of wood pellet boilers and a means to dislodge residual ash and clinker from the grate of a combustion pot of a wood pellet boiler.

BACKGROUND TO THE INVENTION

The present application relates to improvements to granular fuel burning boilers, such was wood pellet boilers, and burners therefor. In particular, the present application relates to an improved access door for the combustion chamber of wood pellet boilers and a means to dislodge residual ash and clinker from the grate of a combustion pot of a wood pellet boiler.

Granular fuel burning boilers have become increasingly common as a renewable source of domestic heat and/or hot water. An example of a granular fuel burning boiler is a wood pellet boiler. Wood pellet boilers typically comprise a hopper for storage of the pelletized wood fuel and a feeding means, such as an auger, for depositing said fuel into a burner or 'combustion pot' located within a combustion chamber where it is ignited and burned. Modern wood pellet boilers can operate automatically in that the pellet feed, ignition and combustion can be controlled by a programmable controller, with the rate of burn being adjustable to selected or pre-set temperatures. As the efficiency of wood pellet boilers increases, and with the advent of various government backed renewable heat incentives, their popularity and demand has also increased.

A significant problem with wood pellet burning boilers is the buildup of residual ash and clinker on the grate of the burner or combustion pot after combustion. Although a relatively small amount of ash is formed, it covers the spaces between the bars of the grate which in turn reduces the effectiveness of the combustion process. A further problem with wood pellet burning boilers is that access to the combustion pot for purposes of maintenance and cleaning is often difficult. This is a particular problem in domestic situations where a boiler is located at a position within a building near a wall or walls such that access on one or more sides is hampered. The present invention therefore attempts to mitigate these problems.

SUMMARY OF THE INVENTION

The present invention provides an access door for the combustion chamber of a wood pellet boiler, the access door comprising a wood pellet burner assembly mounted thereon.

In this way, the wood pellet burner assembly forms part of the access door.

Conveniently, the wood pellet burner assembly is mounted generally to the reverse, i.e. interior side, of the access door.

The present invention also provides a wood pellet boiler comprising a combustion chamber, a wood pellet burner assembly and an access door, characterised in that the wood pellet burner assembly is mounted to the access door.

Conveniently, the access door is hinge mounted to the wood pellet boiler.

In this way, the wood pellet burner assembly is movable from and into the combustion chamber of the wood pellet boiler when the access door is opened and closed, respectively.

Optionally, the wood pellet burner assembly comprises a housing having an upper in use surface adapted to support a combustion pot of the burner assembly.

Optionally, the combustion pot that is removably demountable with respect to the wood pellet burner assembly.

In this way, the combustion pot can be removed for servicing, repair or replacement.

Optionally, the access door is removably demountable with respect to the wood pellet boiler.

Optionally, the combustion pot is retained in place on the upper surface of the wood pellet burner assembly by clips or other suitable releasable retaining means.

In this way, the combustion pot is readily removable by a domestic user for the purpose of cleaning or replacement.

Optionally, the combustion pot comprises a substantially annular member having spaced apart and generally concentric outer and inner walls.

Conveniently, the inner wall defines the boundary of a central combustion region of the combustion pot.

Optionally, the spaced apart outer and inner walls of the combustion pot are joined at their respective upper in use ends by a cap member.

Optionally, the cap member forms a slope leading into the central combustion region of the combustion pot. In this way, pelletized fuel can fall freely into the central combustion region.

Optionally, the combustion pot is generally hollow in construction.

Optionally, the combustion pot further comprises a base plate which substantially covers the lower in use end of the combustion pot.

Optionally, the combustion pot comprises a grate defined by a plurality of spaced apart slots formed in the base plate of the combustion pot.

In this way, adjacent slots in the base plate define the spaced apart bars of the grate.

In this way, the bars of the grate can be integrally formed with, or connected to the combustion pot. For example, where the base plate and the combustion pot are of metal construction, the base plate may be welded to the combustion pot. Alternatively, where the base plate and the combustion pot are made from ceramics, the base plate and the combustion pot may be cast or fused together.

Optionally, the bars of the grate are separate from the combustion pot, i.e. the grate may comprise a separate grate unit, or may comprise a plurality of individual bars which together in use may be arranged in a spaced apart relationship to form a grate.

Optionally, the combustion pot comprises a plurality of apertures provided in its inner wall and cap member.

Optionally, the access door comprises an aperture which allows air to be drawn through the access door.

Conveniently, air is drawn through the aperture in the access door by means of a circulation fan located within the wood pellet boiler.

Optionally, the aperture in the access door is in fluid communication with the wood pellet burner assembly in order to provide airflow to said burner assembly.

In this way, the air drawn through the access door provides combustion air for the combustion process and cooling air for a cleaning mechanism and associated motor in accordance with the invention and located substantially within the burner assembly.

Conveniently, the upper surface of the wood pellet burner assembly comprises a plurality of apertures to enable allow air drawn through the access door to travel through the burner housing and into the space defined by the spaced apart walls of the combustion pot.

Conveniently, the apertures provided in the inner wall and cap member of the combustion pot enable air circulated by the circulation fan through the housing to enter the central combustion region of the combustion pot.

Optionally, the upper surface of the burner housing supports in use a grate having a plurality of spaced apart bars. It will be appreciated that the grate may be formed as part of a combustion pot.

Optionally, the wood pellet burner assembly further comprises an ignition tube extending from the access door to a position proximate the grate. It will be understood that the grate may be formed integrally with the combustion pot, or may comprise a separate grate unit, or may comprise a plurality of individual bars.

Optionally, the burner assembly is provided with a means to dislodge residual ash and clinker from the grate, the means comprising one or more movable members adapted to move in upwards and downwards reciprocating motion between the bars of the grate.

Optionally, the movable members are substantially planar blade or knife members each having an upper in use end that projects above the upper surface of the housing of the burner assembly.

Optionally, motion of the or each blade member is affected by a rotatable rod that extends through and engages in a cam-action with a lower in use end of the each blade member. In this way, each blade member is urged upwardly and downwardly upon rotation of the rod. Upon the upward stroke(s), the upper in use end of one or more blade members is adapted to dislodge any ash or clinker which it contacts.

Optionally, the rod is rotated by a motor provided on or within the access door.

Optionally, each blade member comprises upper and lower elongate slots through which respective upper and lower guide rods extend.

In this way, each blade member remains in a substantially vertical orientation while being urged upwardly and downwardly by the rotatable rod.

Optionally, the upper and lower guide rods are supported at their respective ends by support members.

Advantageously, the blade members, the rotatable rod, the guide rods and their support members are housed substantially within the housing of the burner assembly. In this way, they are cooled by air drawn through the access door and which passes through said housing.

Optionally, a programmable controller is provided so that a cleaning cycle can be performed by the blade members at preprogrammed intervals or upon the detection of a build up of ash or clinker on the grate. It will be appreciated that the cleaning cycle can be performed during operation of the boiler, i.e. when the burner is operating. In addition, such a cleaning cycle may be performed as part of, or in advance of, a burner start-up procedure. Similarly, a cleaning cycle may be performed as part of, or after, a burner shut-down procedure.

Optional features described in relation to one example can optionally be combined alone or together with other features in different examples of the invention.

Various examples of the invention will now be described in detail with reference to the accompanying figures. Still other features, and advantages of the present invention are readily apparent from the entire description thereof, including the figures, which illustrate a number of exemplary implementations. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

All singular forms of elements, or any other components described herein are understood to include plural forms thereof and vice versa.

All numerical values in this disclosure are understood as being modified by "about". All singular forms of elements, or other components described herein are understood to include plural forms thereof and vice versa.

It will be appreciated that the term "at least one" does not impose an upper numerical limit on the number of items or parts referred to.

References to positional descriptions are to be interpreted by a skilled reader in the context of the examples described and are not to be interpreted as limiting the invention to the literal interpretation of the term, but instead should be as understood by the skilled addressee, particularly noting that "interior" with reference to the access door of a wood pellet boiler refers to side of the door that faces into the combustion chamber when closed over in use, and that "exterior" refers to the side of the door that faces away from the combustion chamber when closed over in use.

It will be appreciated that while the features of the present invention are described with particular reference to wood pellet boilers, they are not limited to such use and may be employed with other granular fuel boilers or burners.

DESCRIPTION OF CERTAIN EXAMPLES OF THE INVENTION

Figure 1:
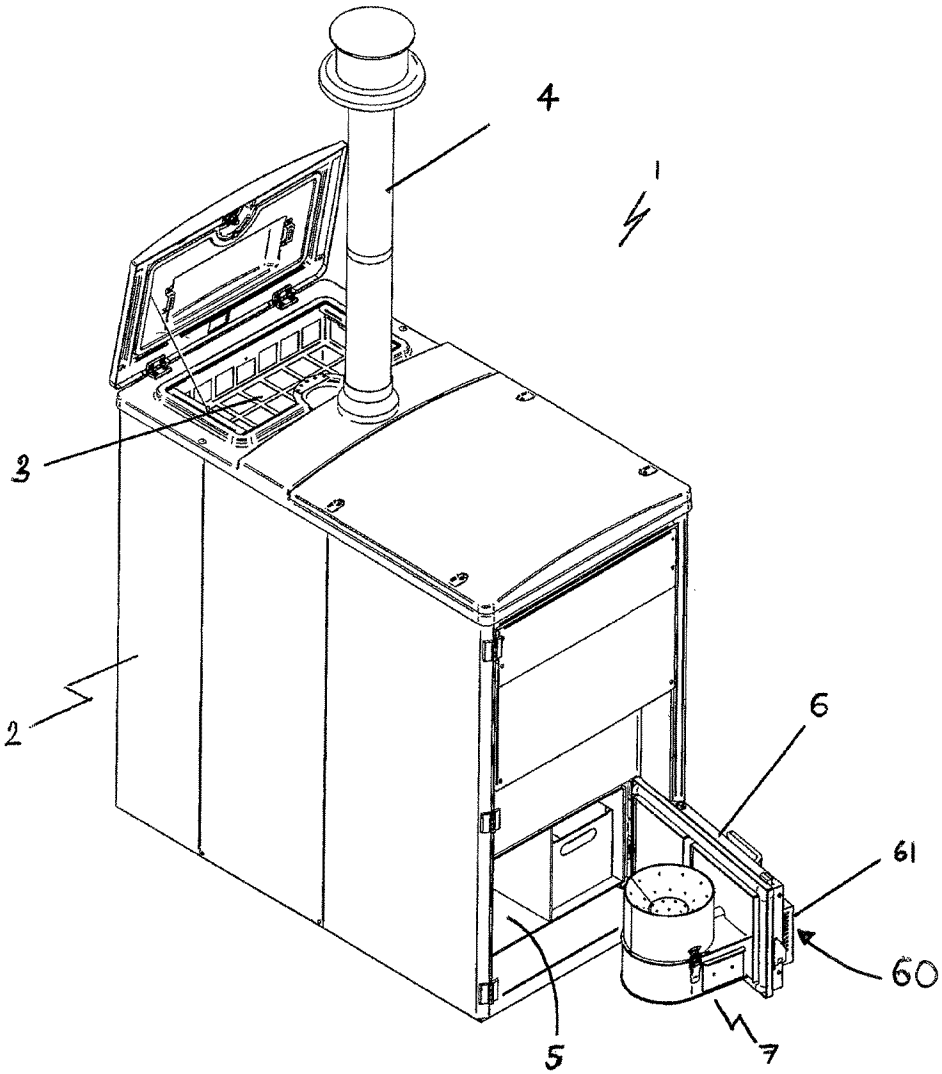
FIG. 1 is a perspective schematic view of an exemplary wood pellet boiler in accordance with the invention having an access door to a combustion chamber shown in an opened configuration.

Referring initially to FIG. 1, there is shown an exemplary wood pellet boiler 1 in accordance with the invention, the wood pellet boiler comprising a an outer casing 2, a hopper 3, an external flue 4, a fuel feed mechanism (not shown), a combustion chamber 5, an access door 6 leading to the combustion chamber, and a burner assembly 7 mounted to the access door 6. A further door (not shown), forming part of the outer casing 2, may also be provided to conceal access door 6 in use. Access door 6 is hinge mounted to the wood pellet boiler.

Figure 2:
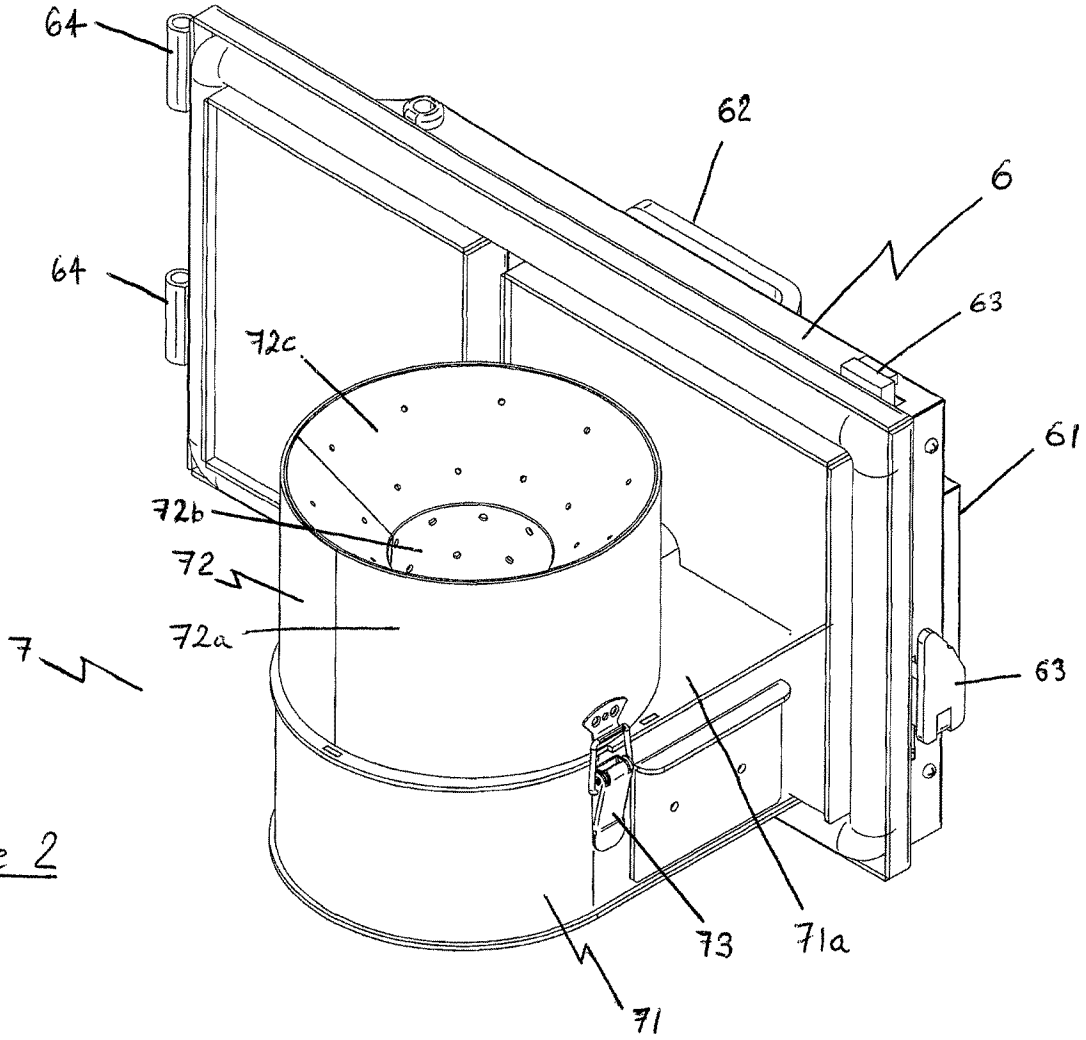
FIG. 2 is a perspective detailed schematic view of the access door of FIG. 1.

As shown in FIG. 2, access door 6 is further provided with a locking handle 62 on its exterior side, one or more locking levers or bolts 63 along one or more side edges, and one or more hinge barrels 64 adapted to cooperate with one or more corresponding hinge barrels provided on a boiler 1 and through which a hinge pin (not shown) extends in use. It will be appreciated that instead of hinge barrels 64 being provided on the door, the door may be attached to a boiler by any suitable means, for example by means of a conventional hinge mechanism having a hinge pin and leafs that are affixed to the door and boiler, respectively.

Conveniently, the wood pellet burner assembly 7 is mounted to the reverse, i.e. interior side, of the access door 6. In this way, the wood pellet burner assembly 7 is movable from and into the combustion chamber 5 when the access door 6 is opened and closed, respectively.

So that combustion of the fuel pellets may occur, access door 6 further comprises an aperture (not shown) to allow airflow through said access door and into the combustion chamber. A grille 61 may be provided to generally cover but not close the aperture, which is in fluid communication with burner assembly 7. A circulation fan (not shown) located within the wood pellet boiler draws ambient air from the exterior side of the access door to the interior of the access door and through the burner assembly 7 and combustion pot 72 as described below. On access door 6 behind grille 61 there is also located a fan (not shown) which operates to supply air to the ignition means associated with the combustion pot. This fan only operates when the ignition means is activated and is glowing.

Referring to FIG. 2, burner assembly 7 which is mounted to access door 6, generally comprises a housing 71 having an upper in use surface 71*a* adapted to support a removable combustion pot 72. Combustion pot 72 is retained in place on surface 71*a* by clips 73 or other suitable releasable retaining means. In this way, combustion pot 72 is readily removable by a domestic user for the purpose of cleaning or replacement.

Figure 6B:
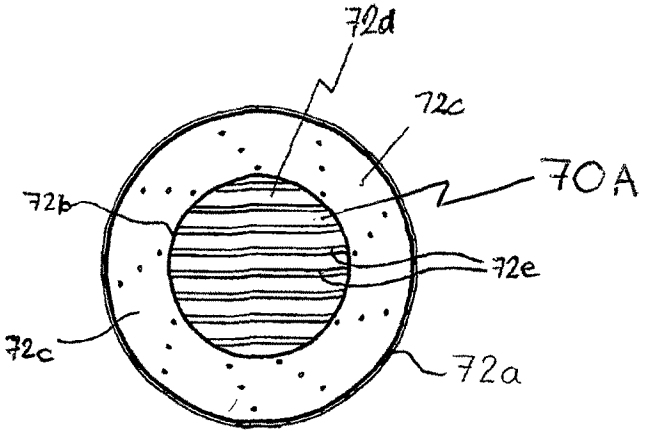
FIGS. 6*a*, 6*b* and 6*c* are further views of an exemplary combustion pot.
Figure 6C:
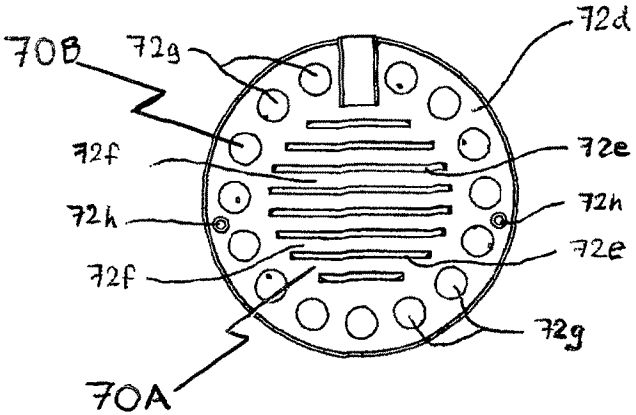
Figure 6A:
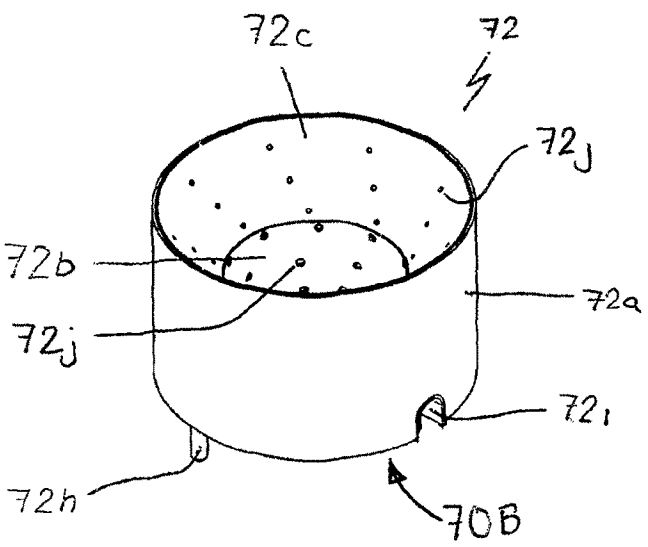

Referring to FIGS. 6*a*, 6*b* and 6*c*, combustion pot 72 comprises a substantially annular member having spaced apart and generally concentric outer 72*a* and inner walls 72*b*. Spaced apart outer 72*a* and inner 72*b* walls are joined at their respective upper in use ends by a cap member 72*c* that slopes to direct granular fuel pellets downwardly into a central combustion region bounded by the inner wall 72*b* of combustion pot 72. Combustion pot 72 is generally hollow in construction. A base plate 72*d* substantially covers the lower in use end of combustion pot 72 as shown in FIGS. 6*b* and 6*c*. The walls 72*a*, 72*b* and cap member 72*c* have a thickness of approximately 2 mm. Base plate 72*d* has a thickness of approximately 10 mm.

As shown in FIGS. 6*b* and 6*c*, in one possible arrangement, the combustion pot 72 further comprises a grate 70*a* in the form a plurality of spaced apart slots 72*e* formed in base plate 72*d* and which extend across the lower in use end of the central combustion region of the combustion pot 72. In this way, adjacent slots 72*e* define the spaced apart bars 72*f* of a grate.

Accordingly, the bars 72*f* of the grate may be integrally formed with, or connected to the combustion pot 72. For example, where the base plate 72*d* and the combustion pot are of metal (e.g. stainless steel) construction, base plate 72*d* may be welded to the combustion pot 72. Alternatively, where base plate 72*d* and the combustion pot are made from a ceramic material, the base plate 72*d* and the combustion pot 72 may be cast or fused together.

It will be appreciated that in other possible arrangements, the grate may be separate from the combustion pot, i.e. the grate may comprise a separate grate unit, or may comprise a plurality of individual bars which may be arranged in a spaced apart relationship to form a grate. In any case, the grate occupies the space at a lower end of the central combustion region of the combustion pot.

Base plate 72*d* is further provided with a plurality of apertures 72*g* which provide openings into the space 70B defined between the spaced apart walls 72*a*, 72*b* of combustion pot 72. When the combustion pot is correctly positioned on upper surface 71*a* of burner assembly housing 71, apertures 72*g* align with apertures 71*b* provided on said upper surface 71*a* as described below. To ensure that apertures 72*g* of the combustion pot align correctly with apertures 71*b* of the burner assembly housing, combustion pot 72 is provided with a plurality of locating pins 72*h* (FIGS. 6*a*, 6*c*) which engage with complementary locating holes 71*c* (FIG. 2) provided on upper surface 71*a* of burner assembly housing 71.

Apertures 71*b* of upper surface 71*a* of burner assembly housing 71 allow air drawn through the access door 6 to travel through housing 71 and via apertures 72*g* into the space 70B between the spaced apart walls 72*a*, 72*b* of combustion pot 72. A plurality of apertures 72*j* (FIG. 6*a*) provided in the inner wall 72*b* and cap member 72*c* of combustion pot 72 in turn enable air from drawn through the access door that has traveled through the housing 71 to enter the central combustion region of the combustion pot 72 (FIG. 2).

An ignition tube 75 extends from access door 6 to a position proximate the grate. The ignition means delivered via tube 75 instigates the ignition of the pellet fuel delivered to, or residing within, combustion pot 72. A cut out portion or portions 72*i* (FIG. 6*a*) formed in or through the walls 72*a*, 72*b* of combustion pot 72 enable ignition tube 75 to extend into or proximate the central combustion region of said combustion pot. In this way, the ignition tube 75 can access the grate in use, whether said grate is formed integrally with the combustion pot, or is formed as a separate grate unit, or as a plurality of individual bars supported on the upper surface 71*a* of burner assembly 7.

Figure 4:
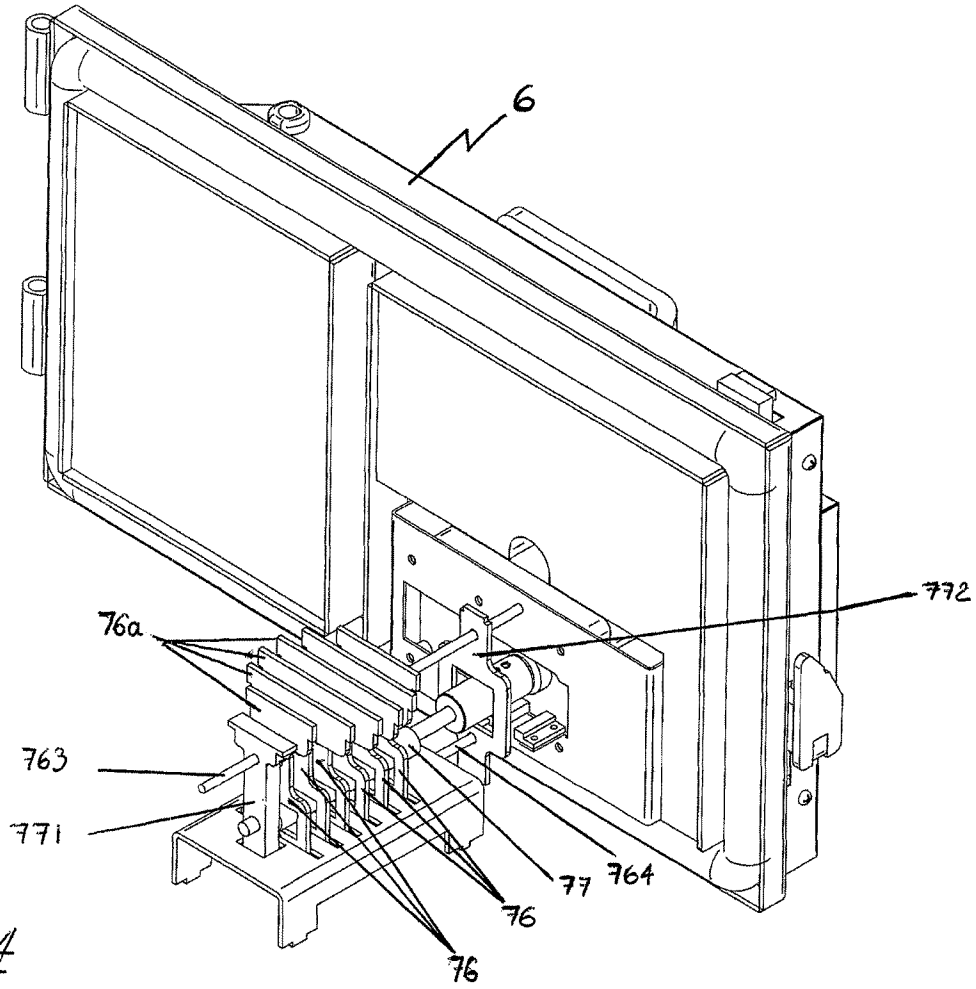
FIG. 4 shows the access door of FIGS. 2 and 3, but with the burner assembly housing removed.
Figure 5:
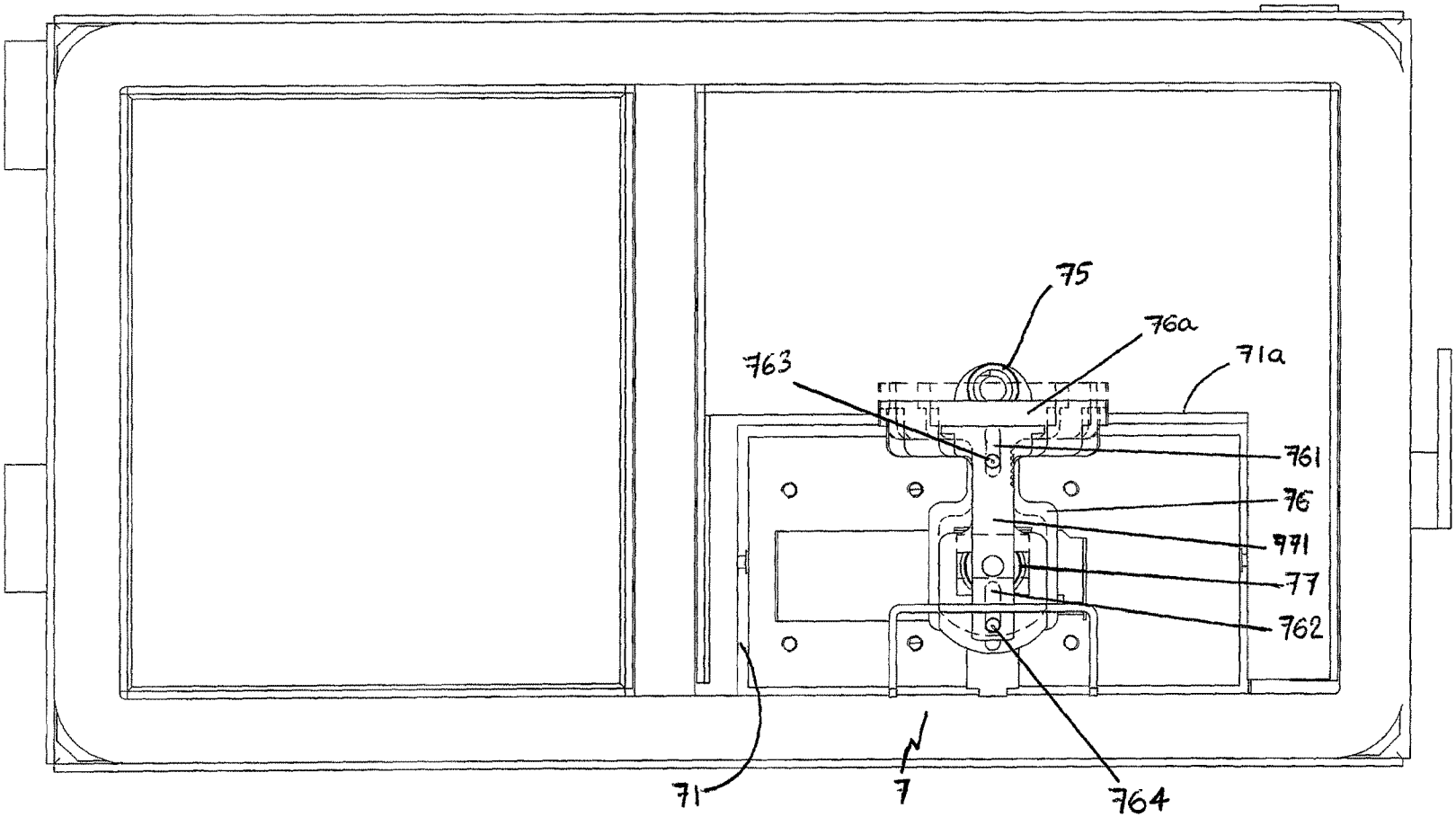
FIG. 5 is an end elevation of the view of FIG. 4.

With reference to FIG. 4 and FIG. 5, burner assembly 7 is provided with a means to dislodge residual ash and clinker from the grate, the means comprising one or more movable members 76 adapted to move in upwards and downwards reciprocating motion between the bars (not shown) of said grate. Ideally, there are provided a plurality of members 76. Members 76 are substantially planar blade or knife members each having an upper in use end 76*a* that projects above surface 71*a* of burner assembly housing 71 as shown in FIGS. 2 and 5. Motion of the or each blade member 76 is affected by a rotatable rod 77 that extends through and engages in a cam-action with a lower in use end of the each blade member 76. Rod 77 is rotated by a motor (not shown) provided within the access door 6. In FIG. 5, dashed lines show the relative position of one or more blade members 76 when raised by rod 77. Upon the upward stroke(s), the upper in use ends 76*a* of one or more blade members dislodges any ash or clinker which they contact. Conveniently, air drawn through the aperture 60 in the access door as described above not only provides combustion air for the combustion process but also cooling air for the cleaning mechanism and its motor which it passes over and around as it flows through the access door, the burner assembly and onwards to the combustion pot.

Figure 3:
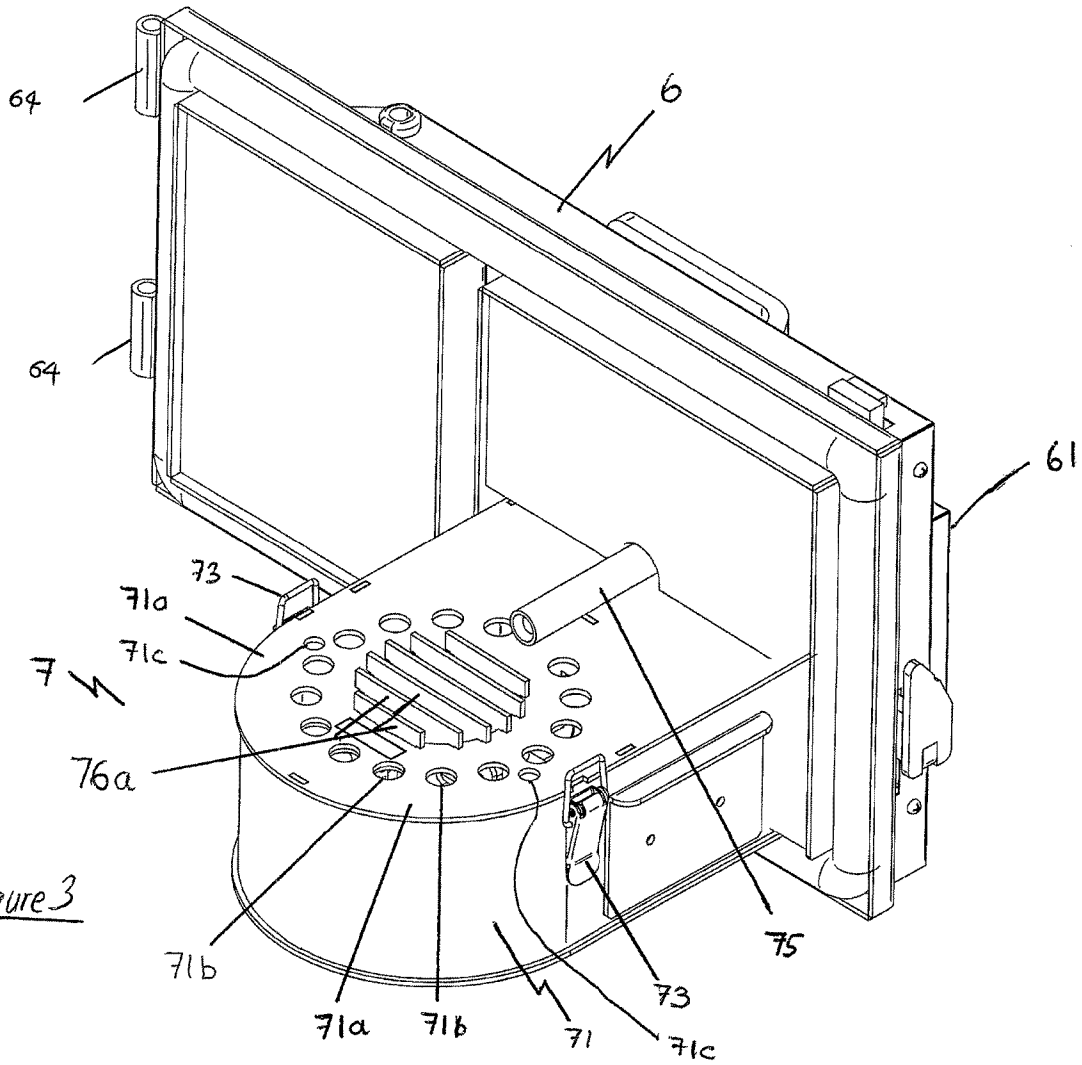
FIG. 3 shows the access door of FIG. 2, but with a combustion pot shown removed from the burner assembly.

With reference to FIG. 3, and the combustion pot 72 as shown in FIGS. 6*b* and 6*c* and having a base plate 72*d*, the upper ends 76*a* of the respective blade members 76 extend through the slots 72*e* which define the spaced apart bars 72*f* of the grate. Air circulating through the burner assembly can pass through said grate into the central combustion region of combustion pot 72.

To ensure that the or each blade member 76 remains in a substantially vertical orientation while being urged upwardly and downwardly by rod 77, the or each blade member comprises respective elongate upper 761 and lower 762 guide slots through which upper 763 and lower guide 764 rods extend. Guide rods 763 and 764 are supported at their respective ends by supports 771, 772 (FIG. 4).

Conveniently, a programmable controller (not shown) is provided so that a cleaning cycle can be performed by the blade members 76 at regular intervals, or upon the detection of a build up of ash or clinker on the grate. It will be appreciated that the cleaning cycle can be performed during operation of the boiler, i.e. when the burner is operating. In addition, such a cleaning cycle may be performed as part of, or in advance of, a burner start-up procedure. Similarly, a cleaning cycle may be performed as part of, or after, a burner shut-down procedure.

Advantageously, blade members 76, rod 77, guide rods 763, 764 and support members 771, 772 are housed substantially within housing 71 of burner assembly 7. In this way, they are cooled by air circulated by the circulation fan which passes through said housing as previously described.

As the burner assembly 7 forms part of the access door 6 of the boiler to which it is mounted, it is easily accessible by a user or technician. To access the various burner components, one need only open the access door 6 whereby said burner components are moved outwardly from the combustion chamber of the wood pellet boiler 1. This obviates the need to remove one or more parts of the outer casing 2 of the boiler, which is often the case with prior art boilers. In turn, this means that a boiler 1 in accordance with the invention, or having an access door 6 in accordance with the invention, can be installed in an enclosed space where access to only one side is possible. Similarly, incorporating the burner assembly 7 with the access door 6 reduces the time to assemble a boiler during manifesting. Still furthermore, a field technician can simply replace a door 6 should one or more parts or functions of the burner fail and cannot be repaired or replaced on site. In this way, the end user can resume use of their boiler with minimal down-time. Furthermore, by locating the grate cleaning mechanism and its motor upon the access door, both the cleaning mechanism and its motor are cooled by air circulating through said access door as it flows through the burner assembly.

The invention claimed is:

1. An access door for a combustion chamber of a wood pellet boiler, the access door comprises a wood pellet burner assembly, characterised in that the wood pellet burner assembly comprises:

a housing having a surface adapted to support a combustion pot of the wood pellet burner;

a grate comprising a plurality of spaced apart bars;

a cleaning mechanism to dislodge residual ash and clinker from the grate, the cleaning mechanism comprising one or more movable members adapted to move in upwards and downwards reciprocating motion between the bars of the grate, wherein each movable member comprises a substantially planar blade member having an upper in use end that projects above the upper surface of the wood pellet burner housing, wherein motion of each blade member is affected by a rotatable rod that extends through and engages in a cam-action with a lower in use end of each blade member, the rotatable rod being rotated in use by a motor provided within the access door; and wherein the access door comprises an aperture for air to be drawn by a circulation fan of the wood pellet boiler through the access door, the aperture being in fluid communication with the wood pellet burner assembly, whereby air circulated through the aperture provides combustion air for the combustion pot, cooling air for the housing of the wood pellet burner assembly, and cooling air for the cleaning mechanism and its motor.

2. The access door of claim 1, wherein the access door is hinge mountable to the wood pellet boiler.

3. The access door of claim 1, wherein the combustion pot is removably demountable with respect to the wood pellet burner assembly.

4. The access door of claim 3, wherein the combustion pot comprises a substantially annular member having spaced apart and generally concentric outer and inner walls joined by a cap member.

5. The access door of claim 4, wherein the combustion pot is generally hollow and comprises a plurality of apertures provided in its inner wall and/or cap member.

6. The access door of claim 4, wherein the upper surface of the housing comprises a plurality of apertures for air drawn by the circulating fan of the wood pellet boiler can travel through the housing and into a space defined by the inner and outer walls of the combustion pot.

7. The access door of claim 1, wherein the spaced apart bars of the grate are defined by a plurality of slots formed in a base plate of the combustion pot.

8. The access door of claim 1, wherein the spaced apart bars of the grate are supported on the upper surface of the wood pellet burner housing.

9. The access door of claim 1, wherein each blade member comprises respective upper and lower elongate slots through which respective upper and lower guide rods extend in use, the guide rods being operable to maintain the blade members in a substantially vertical orientation.

10. A wood pellet boiler comprising an access door for a combustion chamber, the access door comprising: a wood pellet burner assembly, characterised in that the wood pellet burner assembly comprises: a housing having a surface adapted to support a combustion pot of the wood pellet burner; a grate comprising a plurality of spaced apart bars; a cleaning mechanism to dislodge residual ash and clinker from the grate, the cleaning mechanism comprising one or more movable members adapted to move in upwards and downwards reciprocating motion between the bars of the grate, wherein each movable member comprises a substantially planar blade member having an upper in use end that projects above the upper surface of the wood pellet burner housing, wherein motion of each blade member is affected by a rotatable rod that extends through and engages in a cam-action with a lower in use end of each blade member, the rotatable rod being rotated in use by a motor provided within the access door; and wherein the access door comprises an aperture for air to be drawn by a circulation fan of the wood pellet boiler through the access door, the aperture being in fluid communication with the wood pellet burner assembly, whereby air circulated through the aperture provides combustion air for the combustion pot, cooling air for the housing of the wood pellet burner assembly, and cooling air for the cleaning mechanism and its motor.

* * * * *